United States Patent [19]

Seeley

[11] 4,200,873

[45] Apr. 29, 1980

[54] FOLDED TAPERED COAXIAL CAVITY-BACKED ANNULAR SLOT ANTENNA

[75] Inventor: Elwin W. Seeley, San Diego, Calif.

[73] Assignee: The United States of America as represented by the Secretary of the Navy, Washington, D.C.

[21] Appl. No.: 939,734

[22] Filed: Sep. 5, 1978

[51] Int. Cl.[2] ..... H01Q 1/34; H01Q 13/18

[52] U.S. Cl. ..... 343/710; 343/769

[58] Field of Search ..... 343/769, 789, 709, 710, 343/899

[56] References Cited

U.S. PATENT DOCUMENTS

| | | | |
|---|---|---|---|
| 2,644,090 | 6/1953 | Dorne | 343/769 |
| 2,791,769 | 5/1957 | Lindenblad | 343/769 |
| 2,867,803 | 1/1959 | Kerley | 343/769 |

*Primary Examiner*—Eli Lieberman

*Attorney, Agent, or Firm*—R. S. Sciascia; G. J. Rubens; T. M. Phillips

[57] ABSTRACT

A low profile transmitting antenna consisting of a circular slot in a coaxial cavity that is folded several times. The last inner fold of the coaxial cavity is loaded with the tuning coil. The tuning coil can in the alternative be connected in series with the transmitter leeds connected to the radiating slot. Concentric cylinders alternately attached to the top and bottom of the cavity are used to form the folded coaxial cavity that provides the equivalent of a tapered transmission line. Energy to be transmitted is fed across the circular slot of the antenna or in the alternative may be fed into the last inner fold in the center of the cavity. The antenna radiates energy out with the same radiation pattern as a vertical monopole antenna.

6 Claims, 5 Drawing Figures

FOLDED TAPERED COAXIAL CAVITY-BACKED ANNULAR SLOT ANTENNA

BACKGROUND OF THE INVENTION

Modern concepts of integrated operations of submarine and surface fleet units require significant improvements in communications capability with submersibles. It is well known that communications with submarines is improved at greater depths if extremely low frequencies (ELF) are used. The flexibility of using very low frequencies and extremely low frequencies is greatly restricted by available transmitting antennas, particularly when these are on platforms or at locations which have the potential of remaining undetected until the start of a transmission and of surviving energy attack throughout the period of transmission.

SUMMARY OF THE INVENTION

The present invention provides for a folded coaxial cavity-backed annular slot antenna. Concentric cylinders alternately attached to the top and bottom of the cavity are used to form the folded coaxial cavity that provides a long cavity to tune the antenna to resonance since it is very small compared to a wavelength. Since most VLF and ELF signals are transmitted to submarines the antenna may be floated in seawater or set on land. The transmitter feeds energy across the circular slot or into the coaxial fold in the center of the cavity and the slots radiate energy out with the same radiation pattern as a vertical monopole antenna. If the coaxial folds in the cavity are positioned at uniform intervals the cavity appears as a tapered transmission line. If the coaxial folds in the cavity are positioned progressively closer from the outer diameter to the center of the antenna the cavity will appear as a constant characteristic impedance transmission line.

OBJECTS OF THE INVENTION

An object of the invention is the provision of an antenna which can be used for radiating VLF and ELF energy which has a small size compared to the operating wavelength and a low profile.

Another object of the invention is the provision of a folded tapered coaxial cavity-backed annular slot antenna.

Another object of the invention is the provision of a folded coaxial cavity-backed annular slot antenna.

Other objects and many of the attendant advantages of this invention will be readily appreciated as the same becomes better understood by reference to the following detailed description when considered in connection with the accompanying drawings.

DESCRIPTION OF THE PREFERRED EMBODIMENTS

Figure 1:
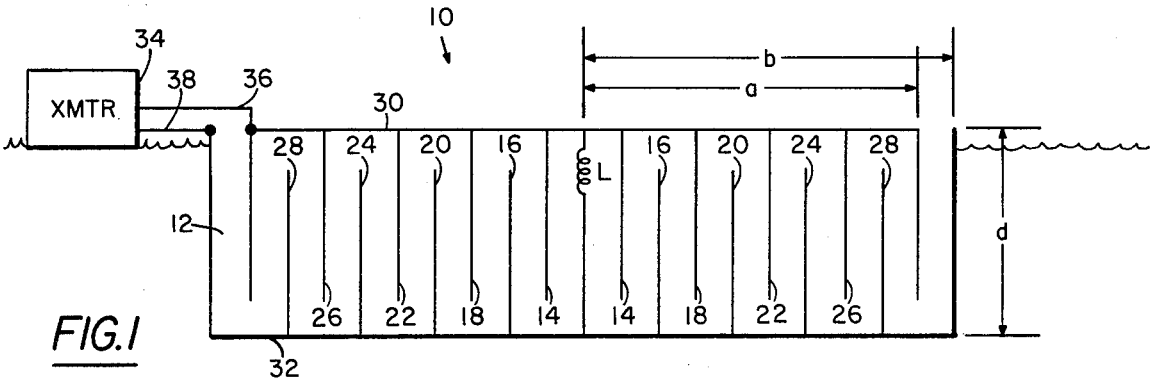
FIG. 1 is a schematic diagram of a folded tapered coaxial cavity-backed annular slot antenna.
Figure 2:
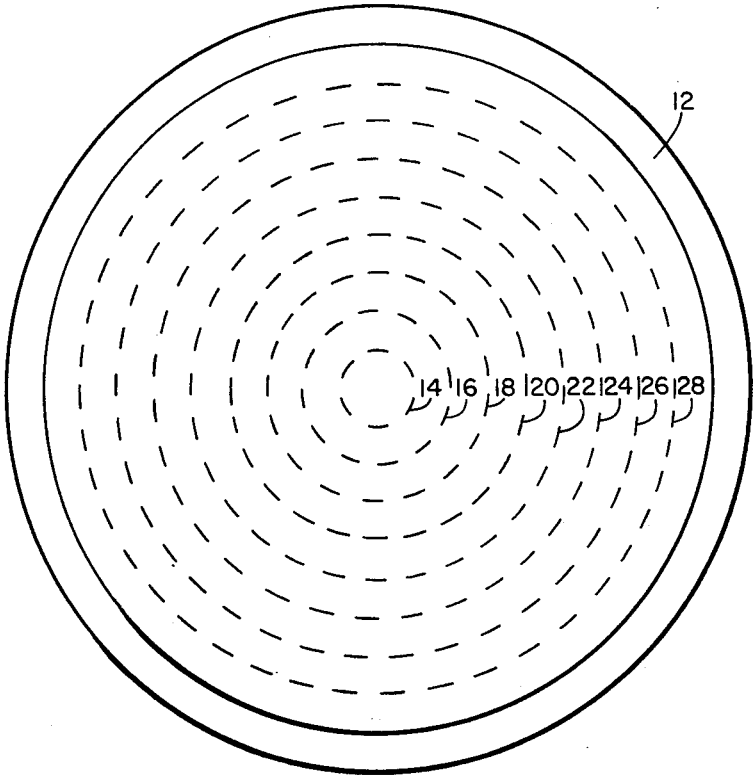
FIG. 2 is a plan view of the antenna of FIG. 1.

Referring now to the drawings wherein there is shown in FIG. 1, antenna 10 is a circular slot 12 having an inner radius a and an outer radius b in a coaxial cavity that is folded many times. Concentric cylinders 14, 16, 18, 20, 22, 24, 26, and 28 are alternately attached, respectively, to the top 30 and bottom 32 of the cavity. This forms a folded coaxial cavity that provides a long cavity to tune the antenna to resonance. This folded cavity takes up a very small space compared to wavelength and to a cavity required to tune the antenna. The last inner fold of the coaxial cavity is loaded with the tuning coil L as shown. The transmitter power from transmitter 34 is connected across slot 12 by means of leads 36 and 38. Antenna 10 as shown in FIG. 1 uses inductive loading with the tuning coil L. Tuning coil L can also be connected in series with the transmitter leads 36 and 38 connected across slot 12.

With antenna 10 floating in seawater, the following parameters were found to be satisfactory.

a=46.87 meters
b=50 meters
d=15.6 meters
frequency of transmitter=100 kHz
L=0.4 Mh
Q=1000
conductance inside the cavity=0 (air filled)
conductance of seawater=4
conductance of structure=$6\times10^6\Omega/M$ (steel)
number of folds=6
radiation efficiency=76%.

Figure 3:
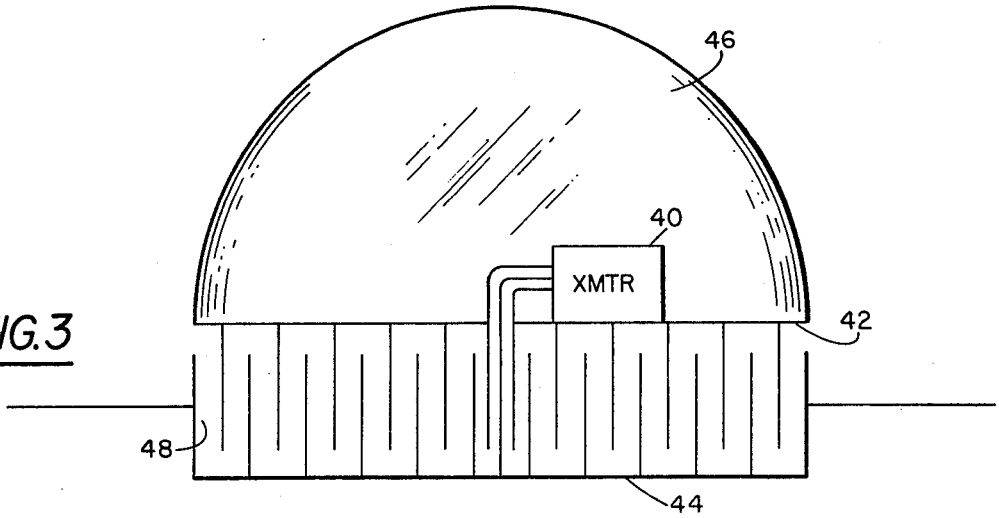
FIG. 3 shows hemispherical loading of the circular slot of FIGS. 1 and 2.
Figure 4:
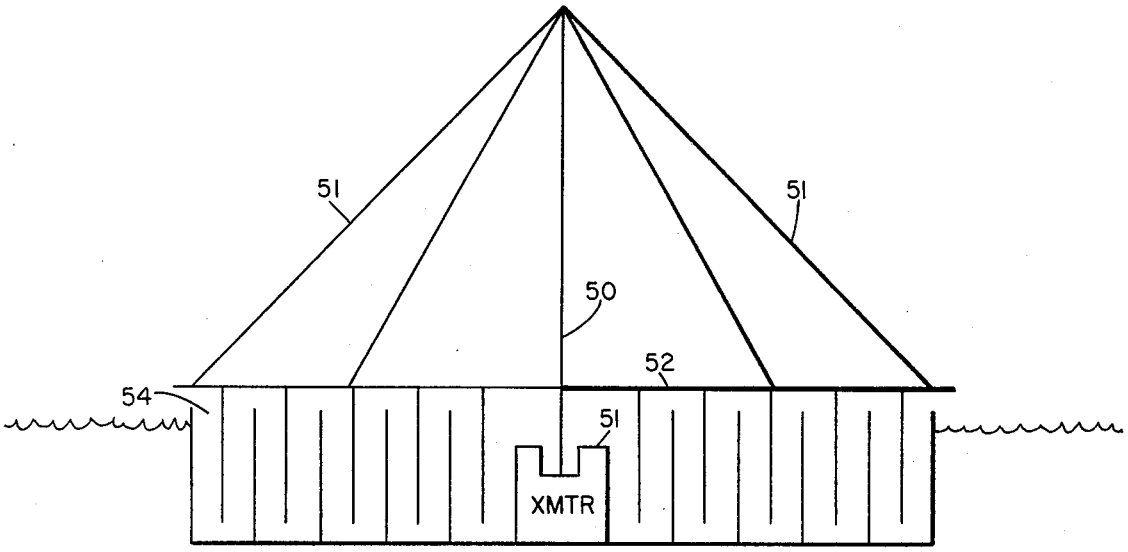
FIG. 4 shows conical loading of the circular slot of FIGS. 1 and 2.
Figure 5:
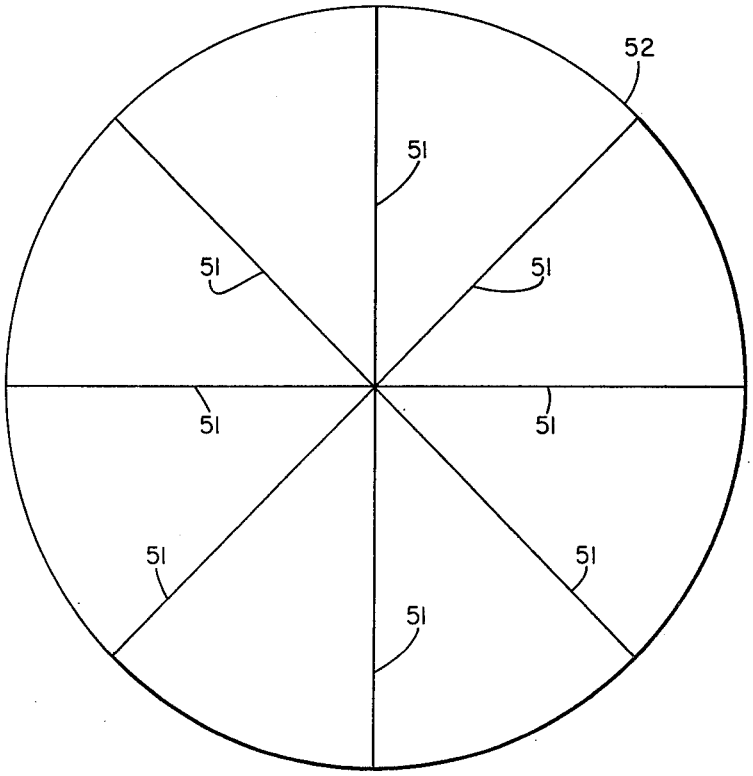
FIG. 5 is a plan view of the antenna of FIG. 4.

The small radiation resistance of the annular slot antenna of FIG. 1, due to its small effective height, reduces radiation efficiency, power radiation capability, and bandwidth. The efficiency is proportional to the square of the effective height and the power radiated is proportional to the fourth power of the effective height of the annular-slot antenna. The reason for this is that antenna capacitance is proportional to the effective height. An increase in antenna effective height can greatly enhance the power radiation capability and efficiency. Greater radiation capability can be achieved by using cavity top-loading as shown in FIGS. 3 and 4. In FIG. 3 a conducting hemisphere 46 is inflated above center plate 42 of the annular slot 48 and in FIG. 4 a center pole 50 holds a cone of 8 guy wires 51 which are attached to the periphery of top plate 52.

Transmitter 40 may be connected as shown in FIG. 3 or it may be connected across the radiating slot 48 in the same manner as transmitter 34 is connected across slot 12 in FIG. 1.

In FIG. 4, transmitter 51 may be connected as shown or may be connected across the radiating slot 54 in the same manner as transmitter 34 is connected across slot 12 in FIG. 1.

Obviously, many other modifications and variations of the present invention are possible in the light of the above teachings. It is therefore to be understood that within the scope of the appended claims the invention may be practiced otherwise than as specifically described.

What is claimed is:

1. An antenna for transmitting VLF/ELF energy comprising:

first and second cylinders positioned with respect to each other to form a circular slot, a plurality of concentric cylinders alternately attached to said first and second clyinders forming a folded coaxial cavity coupled to said first and second cylinders for tuning the antenna to resonance; and top loading means comprising a conducting hemisphere attached to one of said first and second cylinders to increase the radiation efficiency of said antenna.

2. An antenna for transmitting VLF/ELF energy comprising:

first and second cylinders positioned with respect to each other to form a circular slot, a plurality of concentric cylinders alternately attached to said first and second cylinders forming a folded coaxial cavity coupled to said first and second cylinders for tuning the antenna to resonance;

top loading means comprising a cone formed of a center pole and a plurality of guy wires attached to one of said first and second cylinders to increase the radiation efficiency of said antenna.

3. A folded tapered coaxial cavity-backed annular slot antenna comprising:

a first cylinder having a closed end and being of a predetermined diameter;

a second cylinder having a closed end and being of a smaller diameter than said first cylinder and being positioned within said first cylinder so that the walls of said first and second cylinders form an annular slot;

a plurality of concentric cylinders alternately attached to the closed ends of said first and second cylinders;

loading means coupled between the center of the closed ends of said first and second cylinders; and transmitter means connected across said slot formed by the walls of said first and second cylinders.

4. The antenna of claim 3 further comprising top loading means attached to one of said first and second cylinders to increase the radiation efficiency of said antenna.

5. The antenna of claim 4 wherein said top loading means is a conducting hemisphere.

6. The antenna of claim 4 wherein said top loading means is a cone formed of a center pole and a plurality of guy wires.

* * * * *